US009078511B2

(12) United States Patent
Matthews, II

(10) Patent No.: US 9,078,511 B2
(45) Date of Patent: Jul. 14, 2015

(54) HAMMOCK ASSEMBLY

(71) Applicant: Matthews Pride, LLC, Columbia, MD (US)

(72) Inventor: Curtis R. Matthews, II, Columbia, MD (US)

(73) Assignee: Matthews Pride, LLC, Columbia, MD (US)

( * ) Notice: Subject to any disclaimer, the term of this patent is extended or adjusted under 35 U.S.C. 154(b) by 0 days.

(21) Appl. No.: 14/187,039

(22) Filed: Feb. 21, 2014

(65) Prior Publication Data

US 2014/0230146 A1 Aug. 21, 2014

Related U.S. Application Data

(60) Provisional application No. 61/767,719, filed on Feb. 21, 2013.

(51) Int. Cl.
*A45F 3/22* (2006.01)
*D04G 1/00* (2006.01)

(52) U.S. Cl.
CPC ... *A45F 3/22* (2013.01); *D04G 1/00* (2013.01)

(58) Field of Classification Search
CPC ..... A45F 3/22; A45F 3/24; B60N 2/2854; A47G 9/086; A47C 17/78; A47C 17/84
USPC ..... 5/120–130
See application file for complete search history.

(56) References Cited

U.S. PATENT DOCUMENTS

| | | | | | |
|---|---|---|---|---|---|
| 341,793 | A * | 5/1886 | Buckley | 5/123 |
| 408,207 | A * | 8/1889 | Brayshaw | 5/120 |
| 451,009 | A * | 4/1891 | Adams | 5/123 |
| 552,229 | A * | 12/1895 | Bidwell | 5/122 |
| 1,071,954 | A * | 9/1913 | Pietilainen | 5/122 |
| 1,094,921 | A * | 4/1914 | Palmer | 5/124 |
| 1,589,824 | A * | 6/1926 | Specht | 5/122 |
| 1,748,501 | A * | 2/1930 | Stevens | 5/122 |
| 4,112,816 | A * | 9/1978 | Muskus | 87/12 |
| 5,729,845 | A * | 3/1998 | Hsu | 5/120 |
| 6,257,629 | B1 * | 7/2001 | Weichelt | 289/1.5 |
| 7,788,745 | B1 * | 9/2010 | Beaton | 5/120 |
| 2002/0092095 | A1 * | 7/2002 | Starkweather | 5/123 |

FOREIGN PATENT DOCUMENTS

FR 2895888 A1 * 7/2007 ..... A45F 3/22

OTHER PUBLICATIONS

Author Unknown, "Lacrosse Stringing Manual," Warrior Sports, [retrieved on Feb. 3, 2015] 19 pages. Retrieved from: http://images.warrior.com/war-us/pdf/WARRIOR_LacrosseStringingManual_2012.pdf.

* cited by examiner

*Primary Examiner* — Nicholas Polito
*Assistant Examiner* — Myles Throop
(74) *Attorney, Agent, or Firm* — HolzerIPLaw, PC

(57) ABSTRACT

Implementations disclosed herein provide a hammock system, which comprises two spreader bars defining a length of a base area of the hammock system, two border rope defining a width of the base area of the hammock system, a plurality of longitudinally extending structural lines connecting the first spreader bar to the second spreader bar, and a weaving rope defining a repeating array of quadrilateral formations within the base area, each quadrilateral formation bisected by one of the structural lines.

20 Claims, 13 Drawing Sheets

HAMMOCK ASSEMBLY

CROSS-REFERENCE TO RELATED APPLICATIONS

The present application claims benefit of priority to U.S. Provisional Patent Application No. 61/767,719, entitled "Hammock Assembly" and filed on Feb. 21, 2013, specifically incorporated by reference herein for all that it discloses or teaches.

SUMMARY

Implementations disclosed herein include a hammock system and method for manufacturing the base of a hammock system. Specifically, the hammock system comprises two spreader bars defining a length of a base area of the hammock system, two border rope defining a width of the base area of the hammock system, a plurality of longitudinally extending structural lines connecting the first spreader bar to the second spreader bar, and a weaving rope defining a repeating array of quadrilateral formations within the base area, each quadrilateral formation bisected by one of the structural lines.

This Summary is provided to introduce a selection of concepts in a simplified form that are further described below in the Detailed Description. Other implementations are also described and recited herein. This Summary is not intended to identify key features or essential features of the claimed subject matter, nor is it intended to be used to limit the scope of the claimed subject matter. These and various other features and advantages will be apparent from a reading of the following detailed description.

DETAILED DESCRIPTIONS

Figure 1:
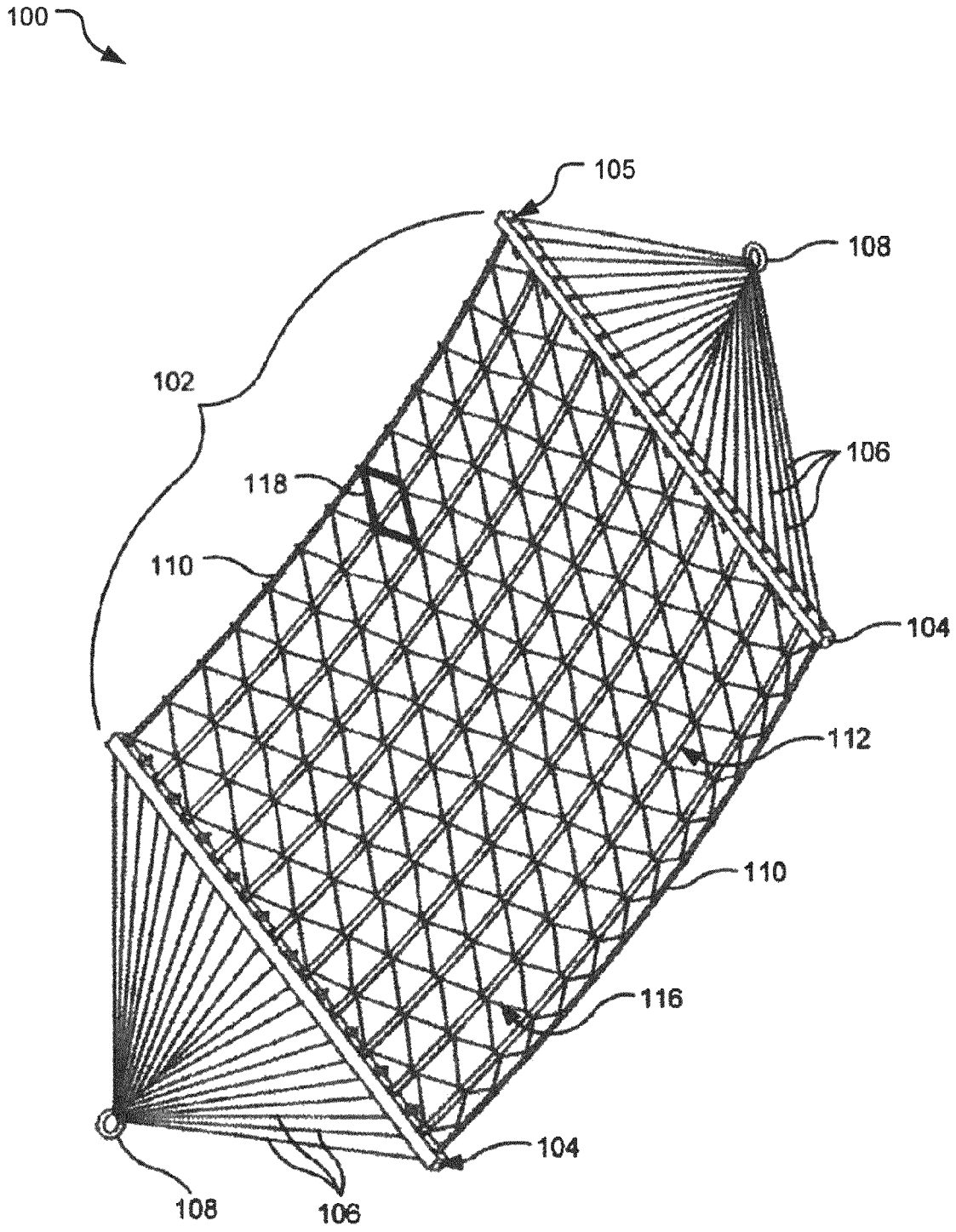
FIG. 1 is a perspective view of an example hammock system in one implementation.

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with other implementations as well. Similarly, however, no single feature or features of any described implementation should be considered essential to the invention, as other implementations of the invention may omit such features.

A base of a hammock strengthened by a weave of structural lines, border rope, and weaving rope intended to support a large amount of weight is described herein. Such a hammock may be used, for example, by larger sized people or by more than one person. Accordingly, disclosed herein are materials, methods, and a system relating to a hammock.

According to one implementation of the present invention, a hammock system may comprise a base, which includes spreader bars, border rope, weaving rope, and/or structural lines, securable to a structure via anchors and hooks (or rings). The structural lines may be positioned substantially equidistant and in substantial parallel alignment to each other extending longitudinally a length of the base when under a tensile load.

Two spreader bars and two border rope form the perimeter of the base. The spreader bars are positioned opposite and parallel to each other, at the longitudinal ends of the base. The two border rope are positioned opposite and parallel to each other, at the latitudinal ends of the base.

A weaving rope may weave and lock singularly around the two border rope and the structural lines longitudinally and laterally. The structural lines, weaving rope, and border rope may connect together to create an overall quadrilateral web formation. The quadrilateral web formation may be rectangular-shaped. The base may further comprise of weaving of the structural lines, weaving rope, and border rope to create a row of quadrilateral-shaped formations, with one structural line extending medially through each quadrilateral formation. The quadrilateral-shaped formations may be diamond-shaped. There may be any number of quadrilateral-shaped formations (e.g., between six and twelve diamond-shaped formations). The more quadrilateral-shaped formations of a similar size that are weaved in the hammock system, the longer the base of the hammock system. Likewise, the greater the number of structural lines with similar spacing therebetween that are used for the base, the wider the base of the hammock system. There may be as many as ten structural lines in the base, however, the number of structural lines may vary.

An interior side of one spreader bar may connect to a right side of the base and an interior side of the other spreader bar may connect to a left side of the base. Two sets of a plurality of anchors may also connect to the spreader bars, on the exterior sides of the spreader bars. A first end of each individual set of anchors may feed through a series of drilled holes in the two spreader bars, from the exterior side of the spreader bar through to the interior side of the spreader bar. There may be any number of drilled holes (e.g., twenty-two (22) drilled holes). The drilled holes may be evenly spaced.

There may be various ways that the weaving rope is weaved. The weaving rope may be knotted to an end of a first structural line or an end of first border rope as a starting point. The weaving rope may be looped above or below an adjacent second structural line or second border rope. In one implementation, the weaving rope may be relooped above or below the adjacent second structural line or second border rope for extra strength and support.

After looping the weaving rope, the weaving rope can similarly be looped above or below the first structural line or first border rope where weaving originated. Optionally, the weaving loop may be relooped above or below the first structural line or first border rope. Then, this weaving process can be repeated down the length of the two structural lines or border ropes until the end is reached. As the weaving occurs longitudinally across the base length between structural lines or border ropes, the looping is positioned around adjacent loops and quadrilateral-shaped formations can be made in a repeating array between each structural line and border rope. Each quadrilateral-shaped formation is bisected by a structural line. The weaving rope can then be weaved to the end of a third structural line or third border rope and the weaving process can commence again, now between the second and third structural lines or border ropes and continue to additional structural lines or border ropes depending on the desired width of a base.

There may also be various ways that the anchors can be tied to the structural lines, border rope, and/or connector rope. For example, the anchors may feed through the exterior side of the spreader bars through alternating drilled holes and knot to themselves on the interior side of the spreader bars. The anchors may also feed through the exterior side of the spreader bars through the remaining alternating drilled holes and knot to the border rope and/or the structural lines.

In another implementation, a connector rope may feed through the drilled holes and weave or knot to the border rope, structural lines, and/or anchors. In another implementation, the connector rope may feed through the drilled holes and weave or knot to the border rope, structural lines, and/or anchors, and knot on both the interior and exterior sides of the spreader bars.

Hooks may connect to the second end of each set of anchors via weaving or knotting of the anchors around the hooks. Further, a cushion may be affixed to at least one longitudinal end of the base. In another implementation, at least one of the spreader bars may have personalized insignia positioned on the bar. Personalizing at least one spreader bars may be accomplished with a computer numerical control machine system. Additionally, the hammock base may be weaved in various implementations by hand or by a mechanical device, such as a loom.

From a structural standpoint, the particular weave of the ropes and the structural lines strengthens the hammock base and provides for significantly more weight than hammocks known in the art. The structural lines may comprise of any kind of organic or synthetic material (e.g., leather). The ropes, anchors, and hooks may comprise of various materials, including, but not limited to, synthetic material or organic material. For example, coiled nylon, mesh, laces, and hemp may be used. The spreader bars may also comprise of various materials, including, but not limited to, synthetic material or organic material (e.g., bamboo wood).

FIG. 1 is a perspective view of an example hammock system 100. As shown in FIG. 1, the hammock system comprises a base 102, which includes spreader bars 104, border rope 110, and structural lines 112 securable to a structure via anchors 106 and hooks 108. The base 102 of the hammock system 100 is strengthened by the particular weave of structural lines 112, border rope 110, and weaving rope 116. In FIG. 1, the base 102 has ten structural lines 112, two border rope 110, and weaving rope 116. The ten structural lines 112 are positioned substantially equidistant and in substantial parallel alignment to each other extending longitudinally a length of the base 102.

As shown in FIG. 1, border rope 110 are positioned on the top side and bottom side of the base 102 extending longitudinally a length of the base 102 positioned in substantial parallel alignment above the ten structural lines 112. A weaving rope 116 weaves and locks singularly around the structural lines 112 longitudinally and laterally, connecting together to create an overall rectangular web formation, wherein the overall rectangular web formation of the base 102 further comprises weaving of the structural lines 112, the border rope 110, and the weaving rope 116 to create a row of twelve quadrilateral-shaped formations 118, with one structural line 112 extending medially through each quadrilateral-shaped formation 118 in a row.

An interior side of a spreader bar 104 connects to the right side of the base 102 and an interior side of a second spreader bar 104 connects to the left side of the base 102. Two sets of anchors 106 are positioned on exterior sides of both spreader bars 104. A first end of each individual anchor in each set of anchors 106 feeds through a series of drilled holes (e.g., hole 105) in the two spreader bars 104. Each first end of each anchor in each set of anchors 106 secures in a knot on the interior side of the two spreader bars 104. The anchors 106 either knot to themselves or knot to either the structural lines 112 or the border rope 110. Two hooks 108 connect to the second end of each individual set of anchors 106 through weaving of the anchors 106 around the hooks 108.

Figure 2:
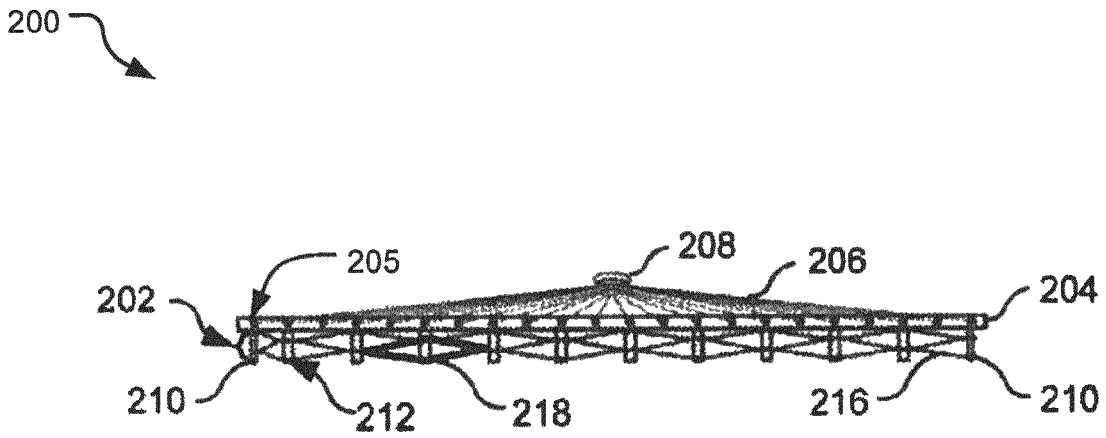
FIG. 2 is a front side view of an example hammock system shown in FIG. 1.

FIG. 2 is a front side view of an example hammock system 200 shown in FIG. 1. As shown, the ten structural lines 212 extend medially through each of the quadrilateral-shaped formations 218. Border rope 210 are positioned on the top side and bottom side of the base 202 extending longitudinally a length of the base 202 positioned in substantial parallel alignment. A weaving rope 216 weaves and locks singularly around the structural lines 212 longitudinally and laterally, connecting together to create an overall rectangular web formation, and further creating a row of quadrilateral-shaped formations 218, with one structural line 212 extending medially through each quadrilateral-shaped formation 218.

As shown in FIG. 2, the interior side of one spreader bar 204 connects to one side of the base 202. A first end of each individual hook 208 in the set of anchors 206 feeds through a series of drilled holes (e.g., hole 205) in the spreader bar 204. Each first end of each anchor 206 secures in a knot on the interior side of the spreader bar 204 with itself, with the structural lines 212, or with the border rope 210. A hook 208 connects to the second end of the set of anchors 206 via weaving of the anchors 206 around the hook 208.

Figure 3:
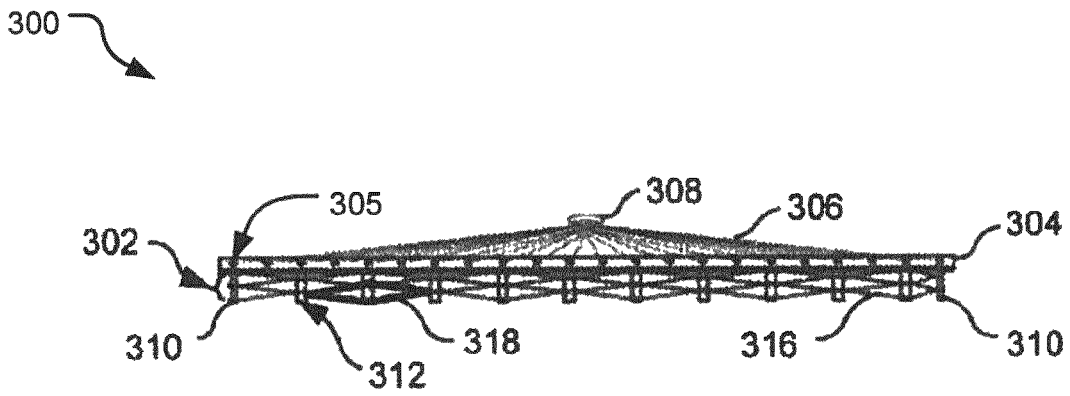
FIG. 3 is a back view of an example hammock system shown in FIG. 1.

FIG. 3 is a back view of an example hammock system 300 shown in FIG. 1, showing the ten structural lines 312 extending medially through each of the quadrilateral-shaped formations 318. Border rope 310 is positioned on the top side and bottom side of the base 302 extending longitudinally a length of the base 302 positioned in substantial parallel alignment to the ten structural lines 312. A weaving rope 316 weaves and locks singularly around the structural lines 312 longitudinally and laterally. The structural lines 312, border rope 310, and the weaving rope 316 connect together to create an overall rectangular web formation. The overall rectangular web formation of the base 302 further comprises weaving of the structural lines 312, the border rope 310, and the weaving rope 316 to create a row of quadrilateral-shaped formations 318, with one structural line 312 extending medially through each quadrilateral-shaped formation 318.

As shown in FIG. 3, the interior side of each spreader bar 304 connects to a right side and left side of the base 302. A first end of each individual anchor in each set of anchors 306 feeds through a series of drilled holes (e.g., hole 305) in the spreader bar 304. Each first end of each hook 308 secures in a knot on the interior side of the spreader bar 304 with itself, with the structural lines 312, or with the border rope 310. Hooks 308 connect to the second end of each set of anchors 306 via weaving of the anchors 306 around the hooks 308.

Figure 4:
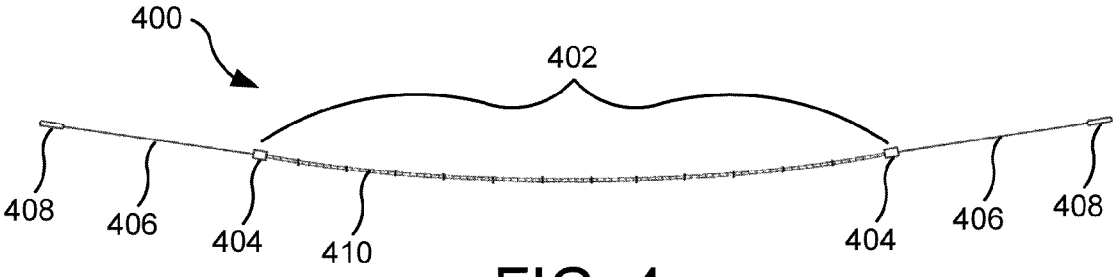
FIG. 4 is a right side view of an example hammock system shown in FIG. 1.

FIG. 4 is a right side view of an example hammock system 400 shown in FIG. 1. Border rope 410 is positioned on the top side and bottom side of the base 402 extending longitudinally a length of the base 402 positioned in substantial parallel alignment to the structural lines 412 (not shown). The interior sides of the two spreader bars 404 connect to the right and left sides of the base 402. A first end of each individual anchor in each set of anchors 406 feeds through a series of drilled holes in the spreader bar 404. Each first end of each anchor in each set of anchors 406 secures in a knot on the interior side of the spreader bar 404 with itself, with the structural lines 412 (not shown), or with the border rope 410. Two hooks 408 connect to the ends of the sets of anchors 406 via weaving of the sets of anchors 406 around each hook 408.

Figure 5:
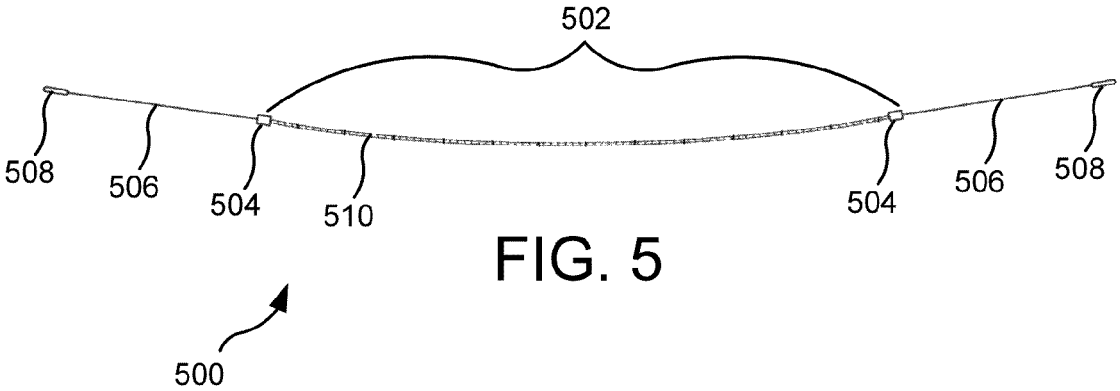
FIG. 5 is a left side view of an example hammock system shown in FIG. 1.

FIG. 5 is a left side view of an example hammock system 500 shown in FIG. 1. Border rope 510 is positioned on the top side and bottom side of the base 502 extending longitudinally a length of the base 502 positioned in substantial parallel alignment to the structural lines 512. The interior sides of the two spreader bars 504 connect to the right and left sides of the base 502. A first end of each individual anchor in the set of anchors 506 feeds through a series of drilled holes in the spreader bar 504. Each first end of each anchor in each set of anchors 506 secures in a knot on the interior side of the spreader bar 504 with itself, with the structural lines 512 (not shown), or with the border rope 510. Two hooks 508 connect to the ends of the sets of anchors 506 through weaving of the sets of anchors 506 around each hook 508.

Figure 6:
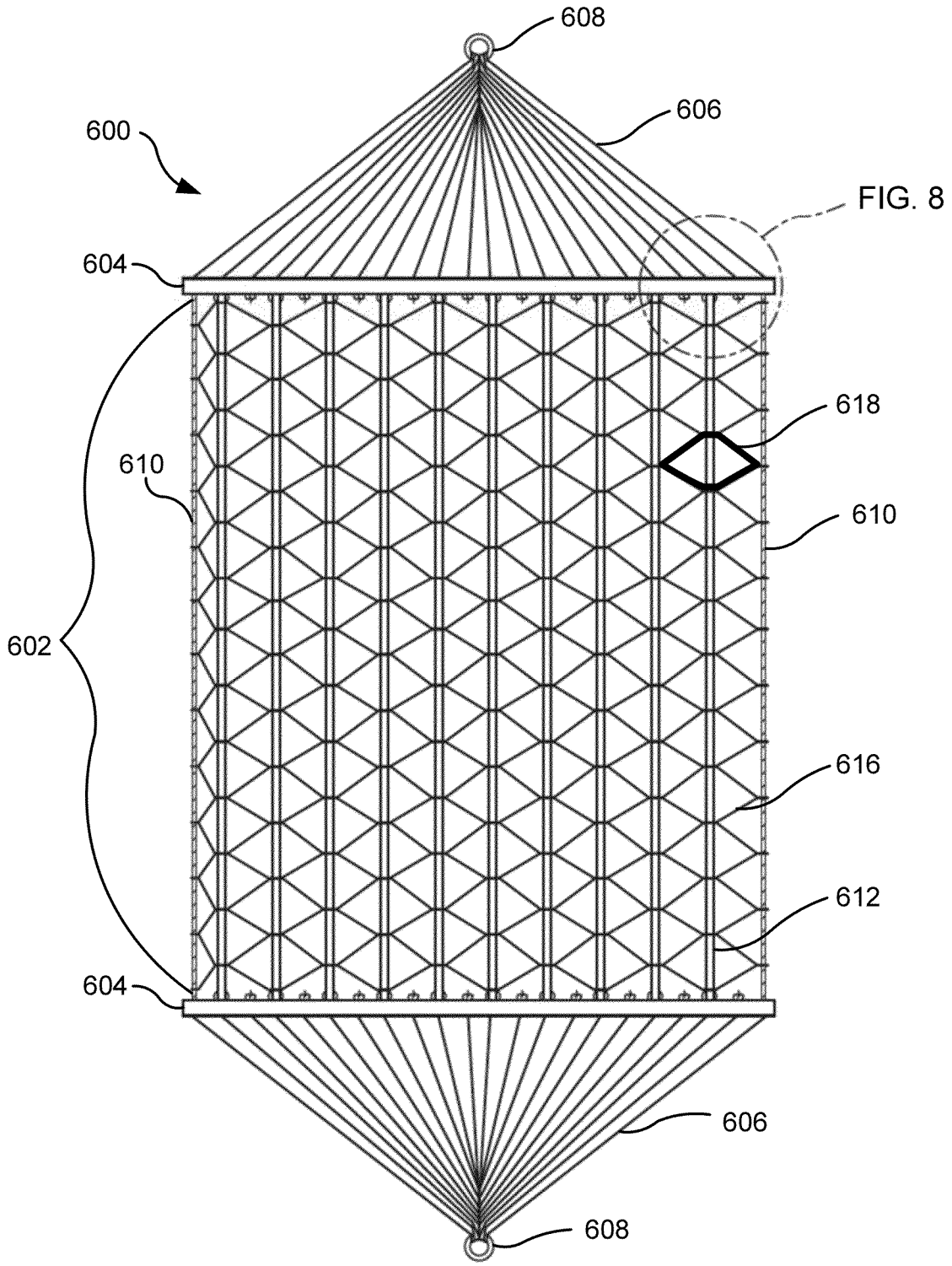
FIG. 6 is a top view of an example hammock system on shown in FIG. 1.

FIG. 6 is a top view of an example hammock system 600 shown in FIG. 1. As shown in FIG. 6, the hammock system 600 comprises a base 602, which includes spreader bars 604, border rope 610, weaving rope 616, and structural lines 612, secured to a structure via anchors 606 and hooks 608. The base 602 of the hammock system 600 is strengthened by the particular weave of structural lines 612 and weaving rope 610. In FIG. 6, the base 602 has ten structural lines 612 positioned equidistant and in substantial parallel alignment to each other extending longitudinally a length of the base 602.

As shown in FIG. 6, border rope 610 is positioned on the top side and bottom side of the base 602 extending longitudinally a length of the base 602 positioned in substantial parallel alignment to the ten structural lines 612. Weaving rope 616 weaves and locks singularly around the structural lines 612 longitudinally and laterally, the structural lines 612, the border rope 610, and the weaving rope 616 connect together to create an overall rectangular web formation. The overall rectangular web formation of the base 602 further comprises weaving of the structural lines 612, the border rope 610, and the weaving rope 616 to create a row of twelve quadrilateral-shaped formations 618, with one structural line 612 extending medially through each quadrilateral-shaped formation 618.

An interior side of a spreader bar 604 connects to the right side of the base 602 and an interior side of a second spreader bar 604 connects to the left side of the base 602. A first end of each individual anchor in each set of anchors 606 feeds through a series of drilled holes in the two spreader bars 604. Each first end of each anchor in each set of anchors 606 secures in a knot on the interior side of the spreader bar 604 with itself, with the structural lines 612, or with the border rope 610. Two hooks 608 connect to the second end of each individual set of anchors 606 through weaving of the set of anchors 606 around the hooks 608.

Figure 7:
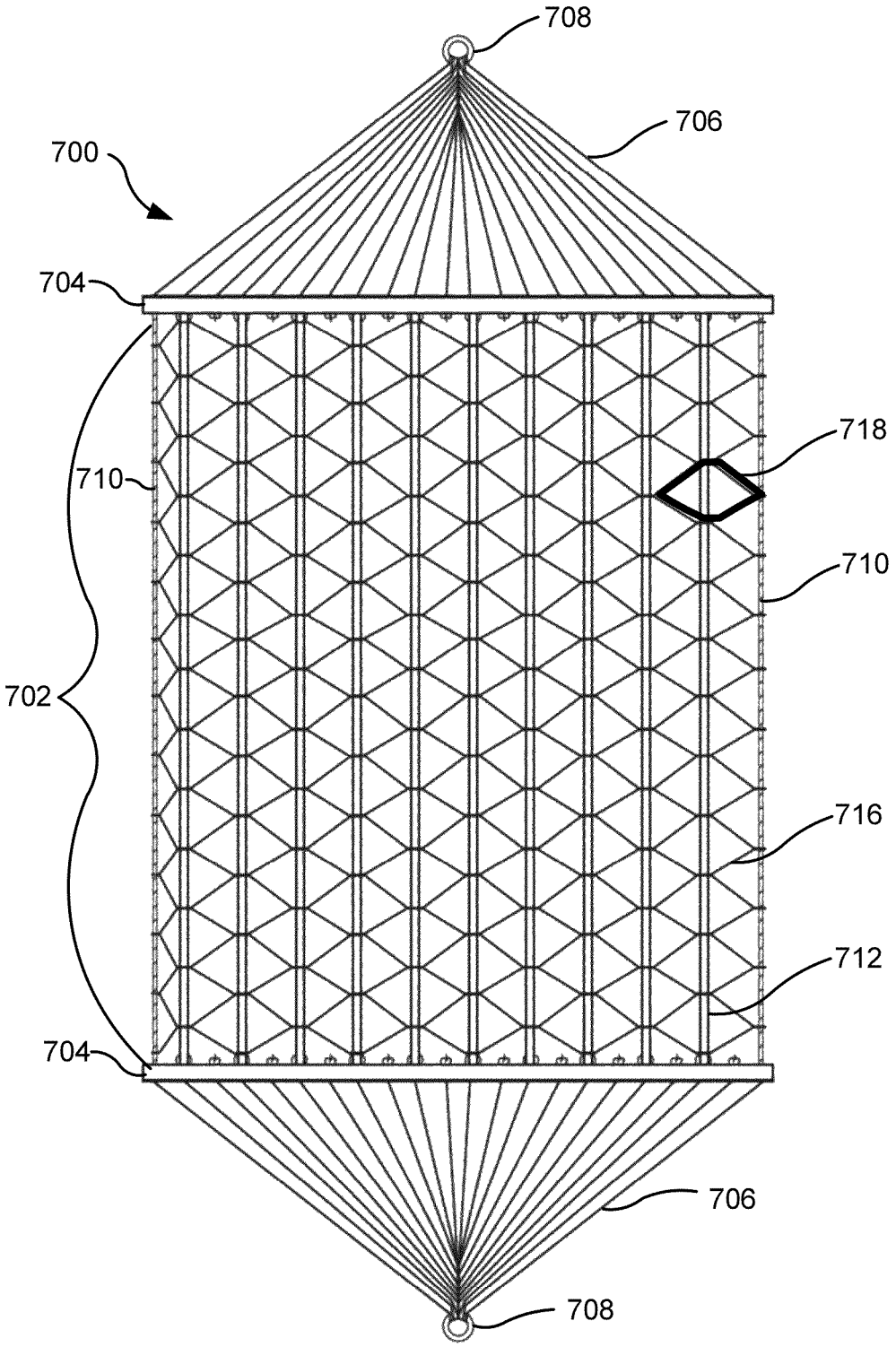
FIG. 7 is a bottom view of an example hammock system shown in FIG. 1.

FIG. 7 is a bottom view of an example hammock system 700 shown in FIG. 1. As shown in FIG. 7, the hammock system comprises a base 702, which includes spreader bars 704, border rope 710, and structural lines 712, securable to a structure via anchors 706 and hooks 708. The base 702 of the hammock system 700 is strengthened by the particular weave of structural lines 712 and weaving rope 716. In FIG. 7, the base 702 has ten structural lines 712 positioned substantially equidistant and in substantial parallel alignment to each other extending longitudinally a length of the base 702.

As shown in FIG. 7, border rope 710 is positioned on the top side and the bottom side of the base 702 extending longitudinally a length of the base 702 positioned in substantial parallel alignment to the ten structural lines 712. A weaving rope 716 weaves and locks singularly around the structural lines 712 longitudinally and laterally, connecting together to create an overall rectangular web formation. The overall rectangular web formation of the base 702 further comprises weaving of the structural lines 712, the border rope 710, and the weaving rope 716 to create a row of twelve quadrilateral-shaped formations 718, with one structural line 712 extending medially through each quadrilateral-shaped formation 718.

An interior side of a spreader bar 704 connects to the right side of the base 702 and an interior side of a second spreader bar 704 connects to the left side of the base 702. A first end of each individual anchor in each set of anchors 706 feeds through a series of drilled holes in the two spreader bars 704. Each first end of each anchor 706 either secures in a knot on the interior side of the spreader bar 704 with itself, with the structural lines 712, or with the border rope 710. Two hooks 708 connect to the second end of each individual set of anchors 706 through weaving of the anchors 706 around the hooks 708.

Figure 8:
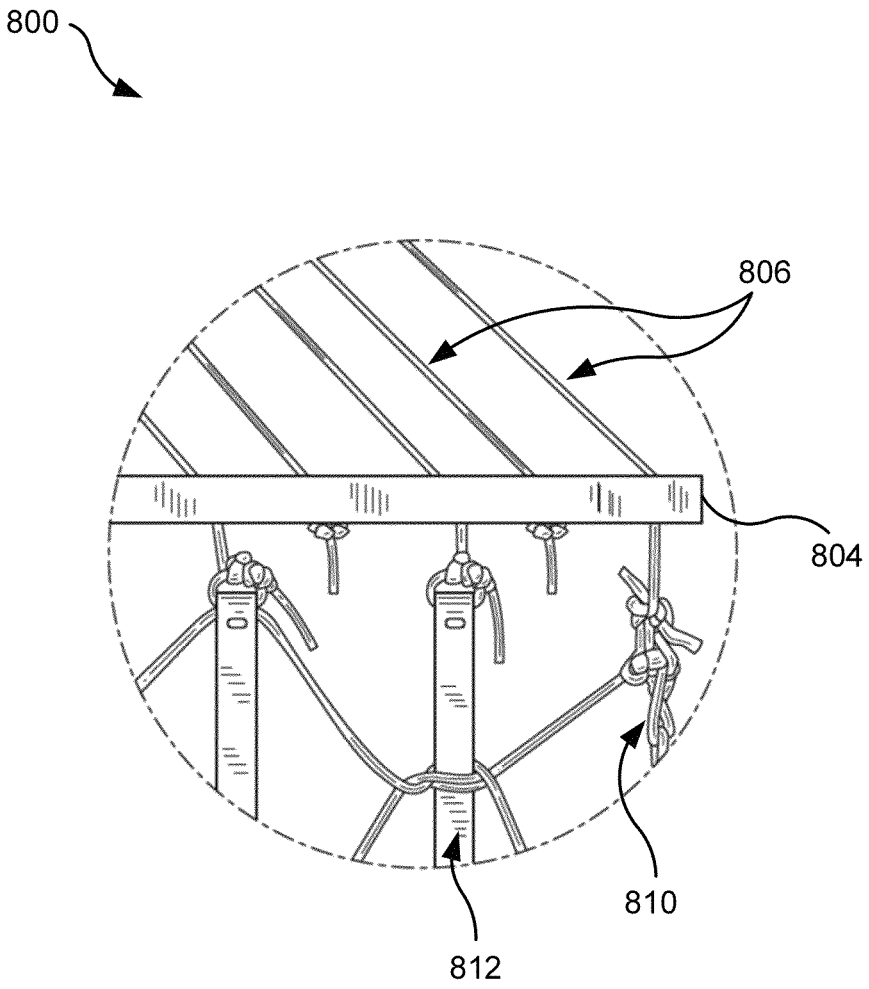
FIG. 8 is an enlarged view of a section of an example hammock system shown in FIG. 1.

FIG. 8 is an enlarged view of a section of the example hammock system 800 shown in FIG. 1. Specifically, FIG. 8 demonstrates one of the ways that the anchors 806 feed through the drilled holes in the spreader bars 804 and may knot to themselves, the border rope 810, and the structural lines 812.

Figure 9:
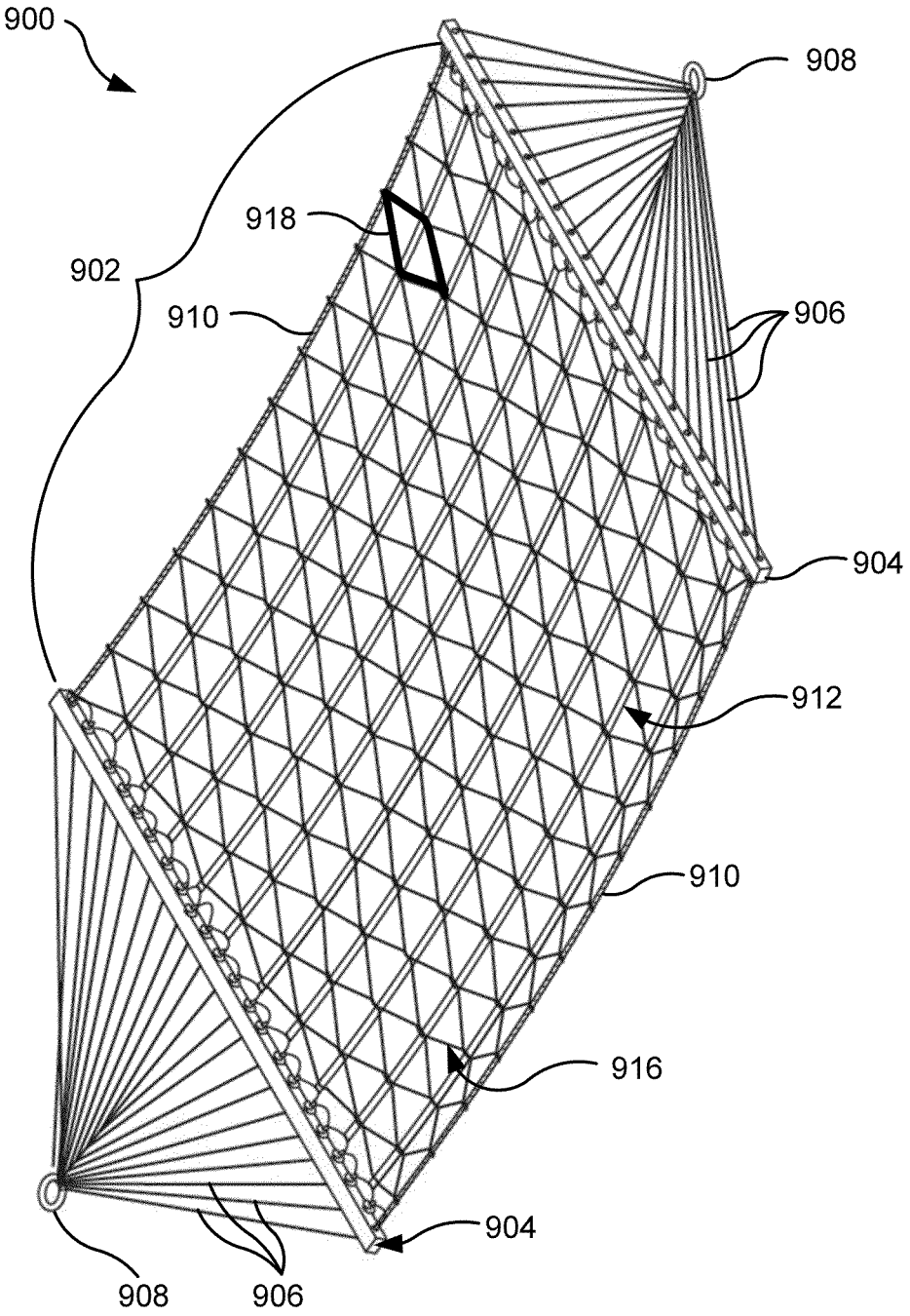
FIG. 9 is a perspective view of an example hammock system in a second implementation.

FIG. 9 is a perspective view of an example hammock system 900 in a second implementation. As shown in FIG. 9, the example hammock system 900 comprises a base 902, which includes spreader bars 904, border rope 910, and structural lines 912, and secures to a structure via anchors 906 and hooks 908. The base 902 of the hammock system 900 is strengthened by the particular weave of structural lines 912 and weaving rope 916. In FIG. 9, the base 902 has ten structural lines 912 positioned substantially equidistant and in substantial parallel alignment to each other extending longitudinally a length of the base 902.

As shown in FIG. 9, border rope 910 is positioned on the top side and the bottom side of the base 902 extending longitudinally a length of the base 902 positioned in substantial parallel alignment to the ten structural lines 912. A weaving rope 916 weaves and locks singularly around the structural lines 912 longitudinally and laterally, connecting together to create an overall rectangular web formation. The overall rectangular web formation of the base 902 further comprises weaving of the structural lines 912 and the weaving 916 to create a row of twelve quadrilateral-shaped formations 918, with one structural line 912 extending medially through each quadrilateral-shaped formation 918.

An interior side of a first spreader bar 904 connects to the right side of the base 902 and an interior side of a second spreader bar 904 connects to the left side of the base 902. A first end of each individual anchor 906 in two set of anchors 906 feeds through a series of drilled holes in the two spreader bars 904. Each first end of each anchor 906 secures in a knot on the interior side of the spreader bar 904 with itself, with the structural lines 912, or with the border rope 910. Two hooks 908 connect to the second end of each individual set of anchors 906 through weaving of the anchors 906 around the hooks 908.

Figure 10:
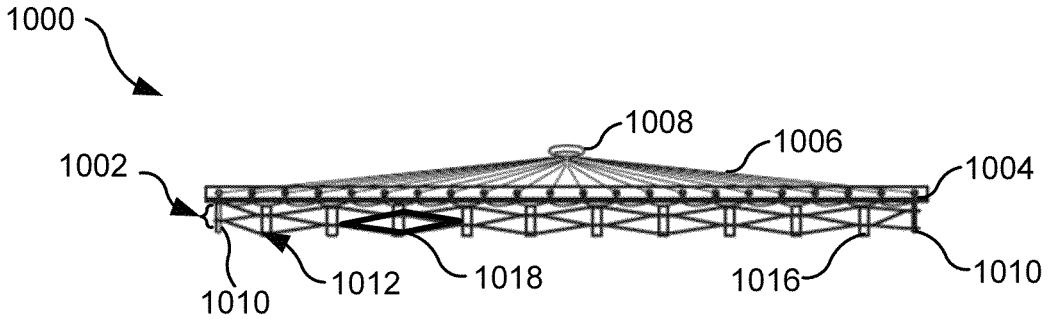
FIG. 10 is a front side view of an example hammock system shown in FIG. 9.

FIG. 10 is a front side view of an example hammock system 1000 shown in FIG. 9. As shown, the ten structural lines 1012 extend medially through each of the quadrilateral-shaped formations 1018. Border rope 1010 is positioned on the top side and bottom side of the base 1002 extending longitudinally a length of the base 1002 positioned in substantial alignment to the ten structural lines 1012. A weaving rope 1016 weaves and locks singularly around the structural lines 1012 longitudinally and laterally, the structural lines 1012, border rope 1010, and weaving rope 1016 connect together to create an overall rectangular web formation. The overall rectangular web formation of the base 1002 further comprises weaving of the structural lines 1012 and weaving rope 1016 to create a row of quadrilateral-shaped formations 1018, with one structural line 1012 extending medially through each quadrilateral-shaped formation 1018 in a row.

As shown in FIG. 10, the interior side of one spreader bar 1004 connects to one side of the base 1002. A first end of each individual anchor in the set of anchors 1006 feeds through a series of drilled holes in the spreader bar 1004. Each first end of each anchor 1006 secures in a knot on the interior side of the spreader bar 1004 with itself, with the structural lines 1012, or with the border rope 1010. A hook 1008 connects to the second end of the set of anchors 1006 through weaving of the anchors 1006 around the hook 1008.

Figure 11:
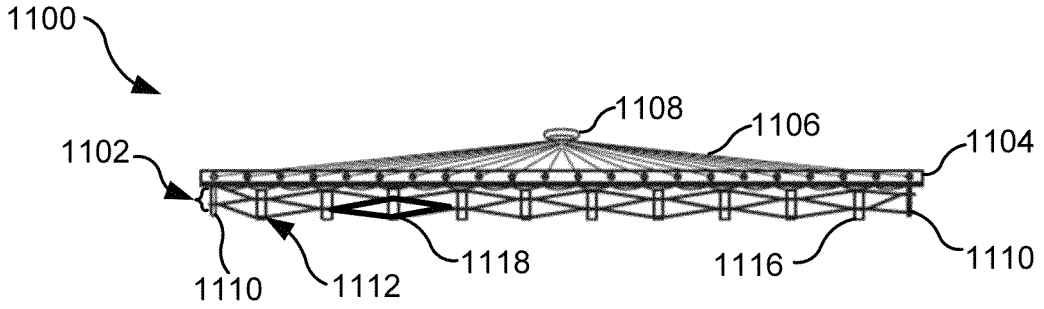
FIG. 11 is a back view of an example hammock system shown in FIG. 9.

FIG. 11 is a back view of an example hammock system 1100 shown in FIG. 9, displaying the ten structural lines 1112 extending medially through each of the quadrilateral-shaped formations 1118 in a row. A border rope 1110 is positioned on the top side and bottom side of the base 1102 extending longitudinally a length of the base 1102 positioned in substantial parallel alignment to the ten structural lines 1112. A weaving rope 1116 weaves and locks singularly around the structural lines 1112 longitudinally and laterally, connecting together to create an overall rectangular web formation. The overall rectangular web formation of the base 1102 further comprises weaving of the structural lines 1112, the border rope 1110, and the weaving rope 1116 to create a row of quadrilateral-shaped formations 1118, with one structural line 1112 extending medially through each quadrilateral-shaped formation 1118 in a row.

As shown in FIG. 11, one spreader bar 1104 connects to one side of the base 1102. A first end of each individual anchor 1106 in the set of anchors 1106 feeds through a series of drilled holes in the spreader bar 1104. Each first end of each anchor 1106 secures in a knot on the interior side of the spreader bar 1104 with itself, with the structural lines 1112, or with the border rope 1110. A hook 1108 connects to the second end of the set of anchors 1106 through weaving of the sets of anchors 1106 around the hook 1108.

Figure 12:
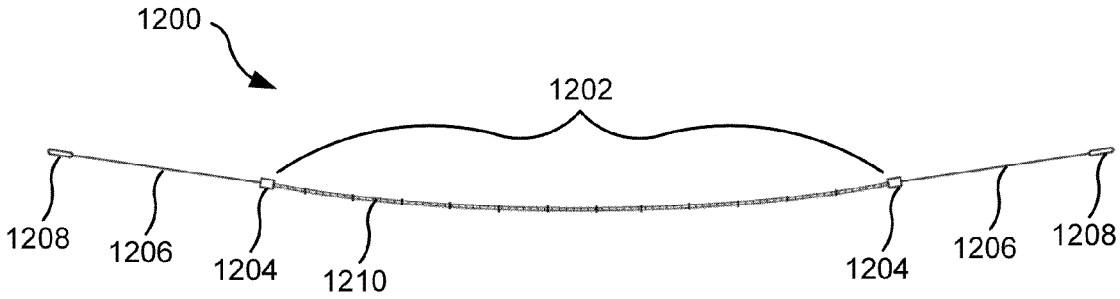
FIG. 12 is a right side view of an example hammock system shown in FIG. 9.

FIG. 12 is a right side view of an example hammock system 1200 shown in FIG. 9. A border rope 1210 is positioned on the top side of the base 1202 extending longitudinally a length of the base 1202 positioned in substantial parallel alignment above the structural lines 1212 (not shown). The interior sides of the two spreader bars 1204 connect to the right side and left side of the base 1202. A first end of each individual anchor 1206 in the set of anchors 1206 feeds through a series of drilled holes in the spreader bar 1204. Each first end of each anchor 1206 secures in a knot on the interior side of the spreader bar 1204 with itself, with the structural lines 1212 (not shown), or with the border rope 1210. Two hooks 1208 connect to the ends of the sets of anchors 1206 through weaving of the sets of anchors 1206 around each hook 1208.

Figure 13:
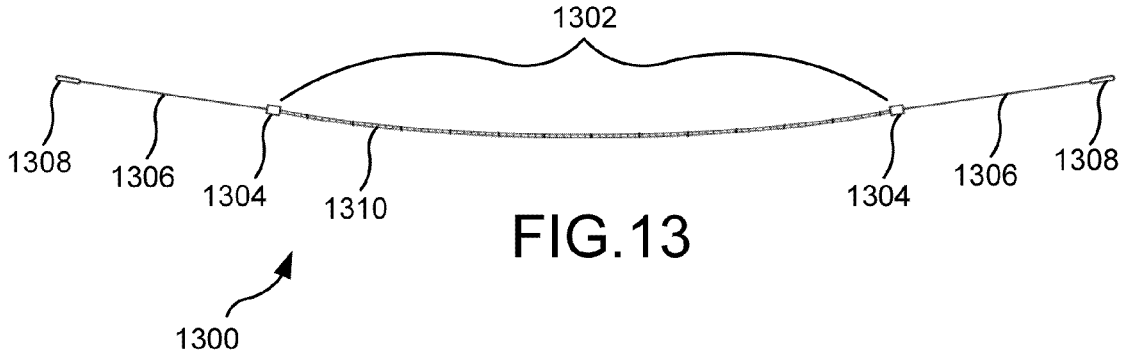
FIG. 13 is a left side view of an example hammock system shown in FIG. 9.

FIG. 13 is a left side view of an example hammock system 1300 shown in FIG. 9. A border rope 1310 is positioned on the bottom side of the base 1302 extending longitudinally a length of the base 1302 positioned in substantial parallel alignment to the structural lines 1312 (not shown). The interior sides of the two spreader bars 1304 connect to the right side and left side of the base 1302. A first end of each individual anchor 1306 in the set of anchors 1306 feeds through a series of drilled holes in the spreader bar 1304. Each first end of each anchor 1306 secures in a knot on the interior side of the spreader bar 1304 with itself, with the structural lines 1312 (not shown), or with the border rope 1310. Two hooks 1308 connect to the ends of the sets of anchors 1306 through weaving of the sets of anchors 1306 around each hook 1308.

Figure 14:
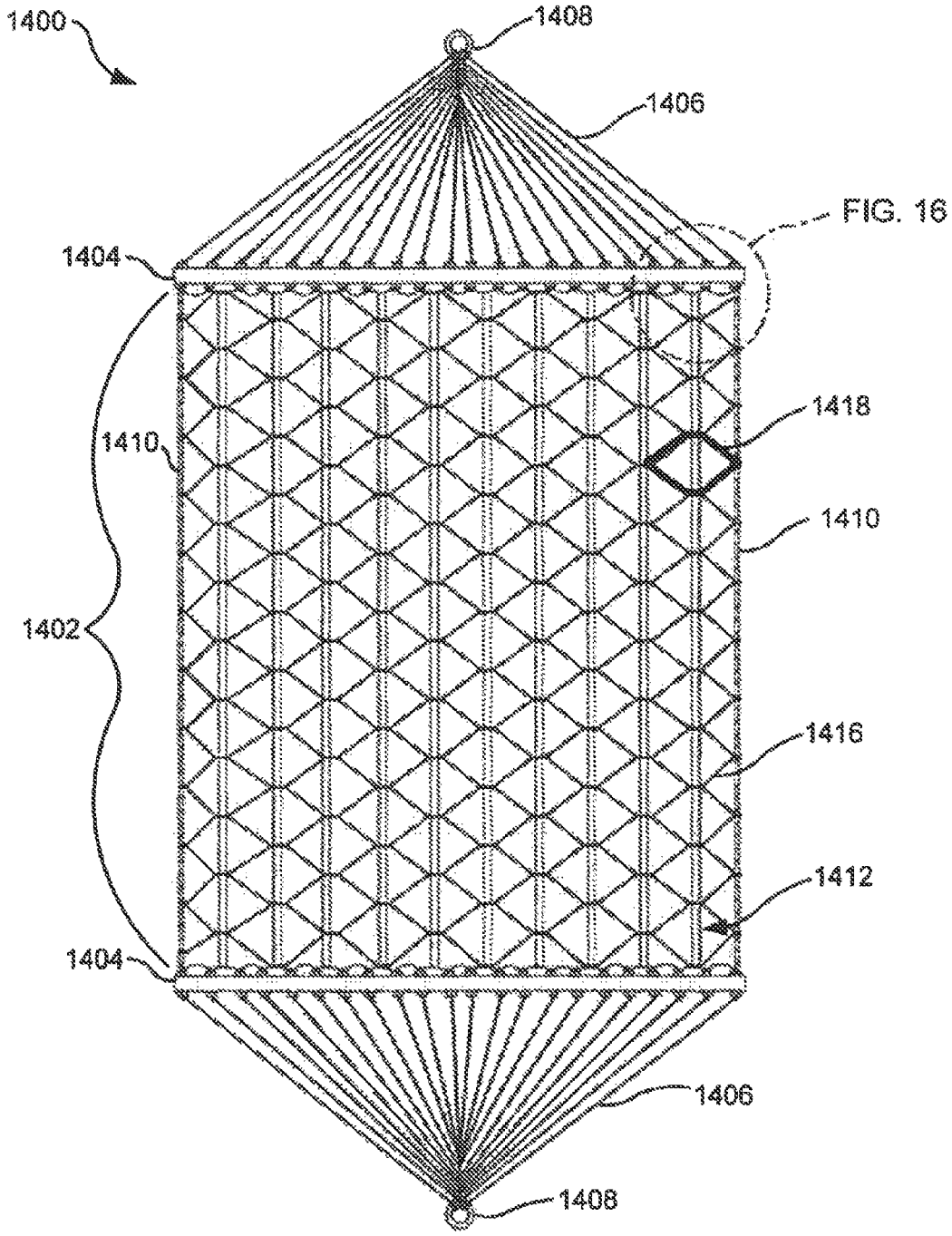
FIG. 14 is a top view of an example hammock system shown in FIG. 9.

FIG. 14 is a top view of an example hammock system 1400 shown in FIG. 9. As shown in FIG. 14, the example hammock system 1400 comprises a base 1402, which includes spreader bars 1404, border rope 1410, structural lines 1412, and weaving rope 1416, secured to a structure via anchors 1406 and hooks 1408. The base 1402 of the hammock system 1400 is strengthened by the particular weave of structural lines 1412 and weaving rope 1416. In FIG. 6, the base 1402 has ten structural lines 1412 positioned substantially equidistant and in substantial parallel alignment to each other extending longitudinally a length of the base 1402.

As shown in FIG. 14, a border rope 1410 is positioned on the top side and the bottom side of the base 1402 extending longitudinally a length of the base 1402 positioned in substantial parallel alignment to the ten structural lines 1412. A weaving rope 1416 weaves and locks singularly around the structural lines 1412 longitudinally and laterally, connecting together to create an overall rectangular web formation. The overall rectangular web formation of the base 1402 further comprises weaving of the structural lines 1412 and weaving rope 1416 to create a row of twelve quadrilateral-shaped formations 1418, with one structural line 1412 extending medially through each quadrilateral-shaped formation 1418 in a row.

An interior side of a spreader bar 1404 connects to the right side of the base 1402 and an interior side of a second spreader bar 1404 connects to the left side of the base 1402. A first end of each individual anchor in each set of anchors 1406 feeds through a series of drilled holes in the two spreader bars 1404. Each first end of each anchor 1406 secures in a knot on the interior side of the spreader bar 1404 with itself, with the structural lines 1412, or with the border rope 1410. Two hooks 1408 connect to the second end of each individual set of anchors 1406 through weaving of the sets of anchors 1406 around the hooks 1408.

Figure 15:
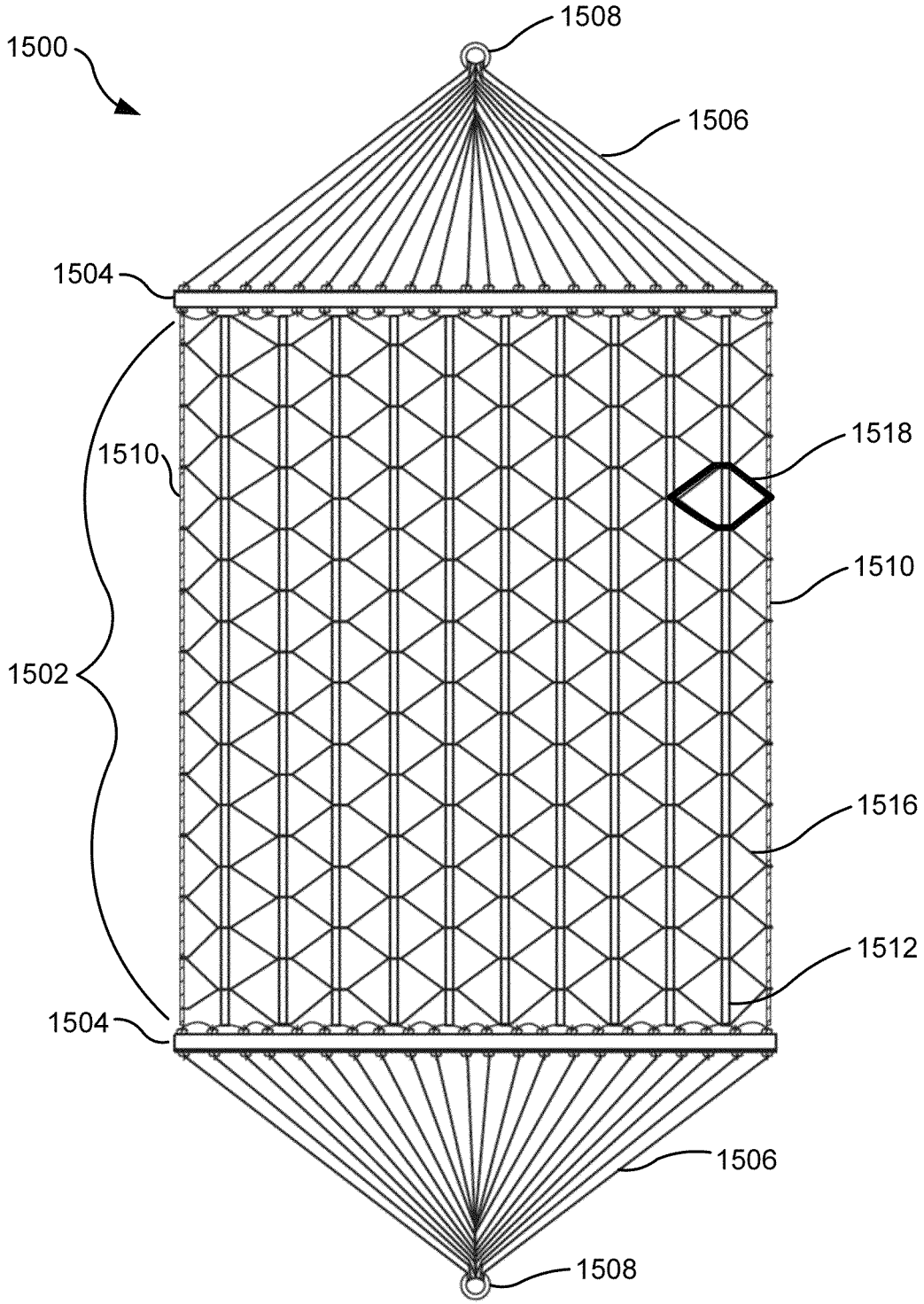
FIG. 15 is a bottom view of an example hammock system shown in FIG. 9.

FIG. 15 is a bottom view of an example hammock system 1500 shown in FIG. 9. As shown in FIG. 15, the hammock system comprises a base 1502, which includes spreader bars 1504, border rope 1510, and/or structural lines 1512, securable to a structure via anchors 1506 and hooks 1508. The base 1502 of the hammock system 1500 is strengthened by the particular weave of structural lines 1512 and weaving rope 1516. In FIG. 7, the base 1502 has ten structural lines 1512 positioned substantially equidistant and in substantial alignment to each other extending longitudinally a length of the base 1502.

As shown in FIG. 15, border rope 1510 is positioned on the top side and the bottom side of the base 1502 extending longitudinally a length of the base 1502 positioned in substantial parallel alignment to the ten structural lines 1512. A weaving rope 1516 weaves and locks singularly around the structural lines 1512 longitudinally and laterally, the structural lines 1512, the border rope 1510, and the weaving rope 1516 connecting together to create an overall rectangular web formation. The overall rectangular web formation of the base 1502 further comprises weaving of the structural lines 1512, the border rope 1510, and the weaving rope 1516 to create a row of twelve quadrilateral-shaped formations 1518, with one structural line 1512 extending medially through each quadrilateral-shaped formation 1518 in a row.

A spreader bar 1504 connects to the right side of the base 1502 and a second spreader bar 1504 connects to the left side of the base 1502. A first end of each individual anchor 1506 in each set of anchors 1506 feeds through a series of drilled holes in the two spreader bars 1504. Each first end of each anchor 1508 secures in a knot on the interior side of the spreader bar 1504 with itself, with the structural lines 1512, or with the border rope 1510. Two hooks 1508 connect to the second end of each individual set of anchors 1506 through weaving of the sets of anchors 1506 around the hooks 1508.

Figure 16:
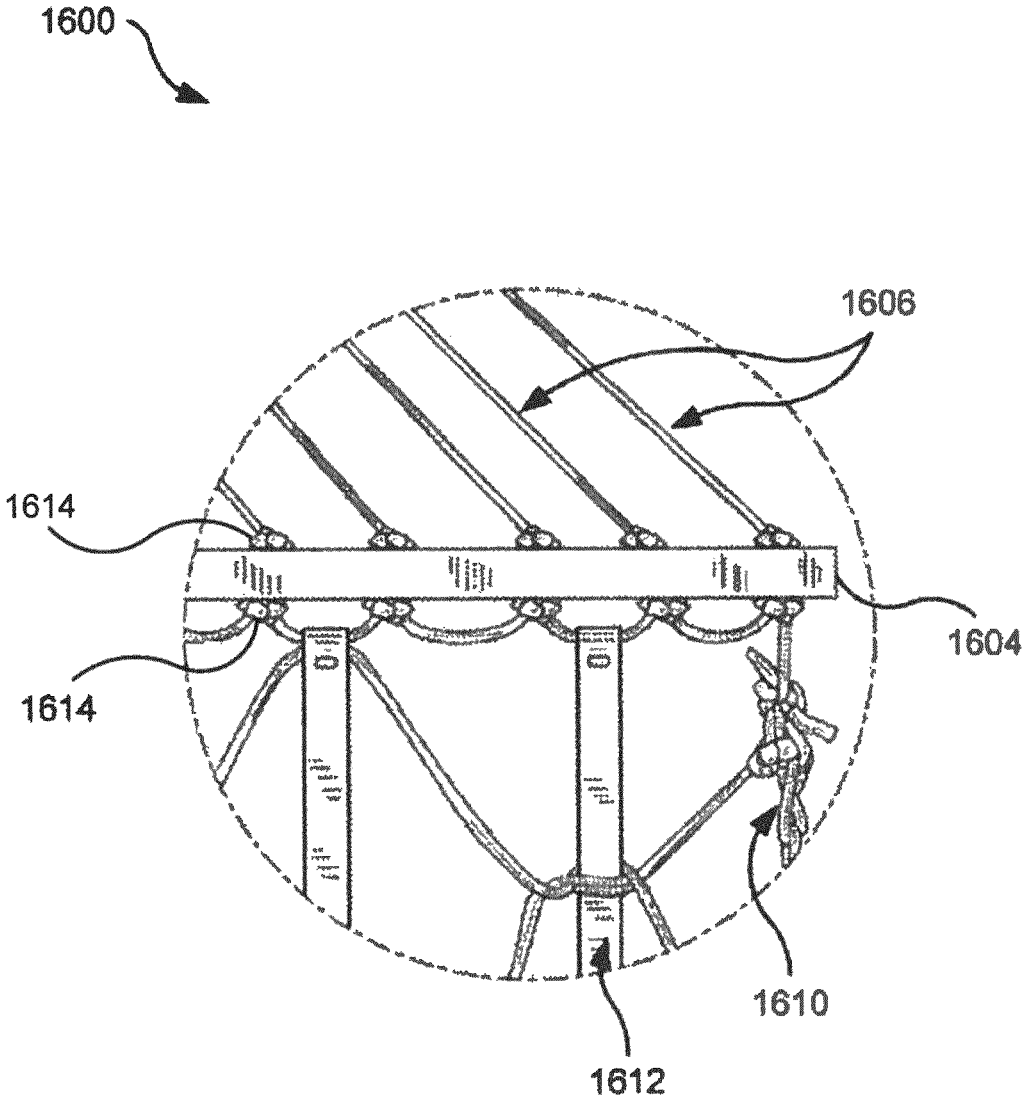
FIG. 16 is an enlarged view of a section of an example hammock system shown in FIG. 9.

FIG. 16 is an enlarged view of a section of an example hammock system 1600 shown in FIG. 9. Specifically, FIG. 16 demonstrates one of the ways that the anchors 1606 may be connected to the hammock base. A connector rope 1614 is fed through the drilled holes of the spreader bars 1604, and may be knotted on both the interior and exterior sides of the spreader bars 1604. A first set of anchors 1606 may be knotted to the connector rope 1614 on the exterior side of the spreader bar 1604. The connector rope 1614 may be knotted to itself and the border rope 1610 on the interior side of the spreader bar 1604. The connector rope 1614 may also loop through the end of the structural lines 1612.

Figure 17:
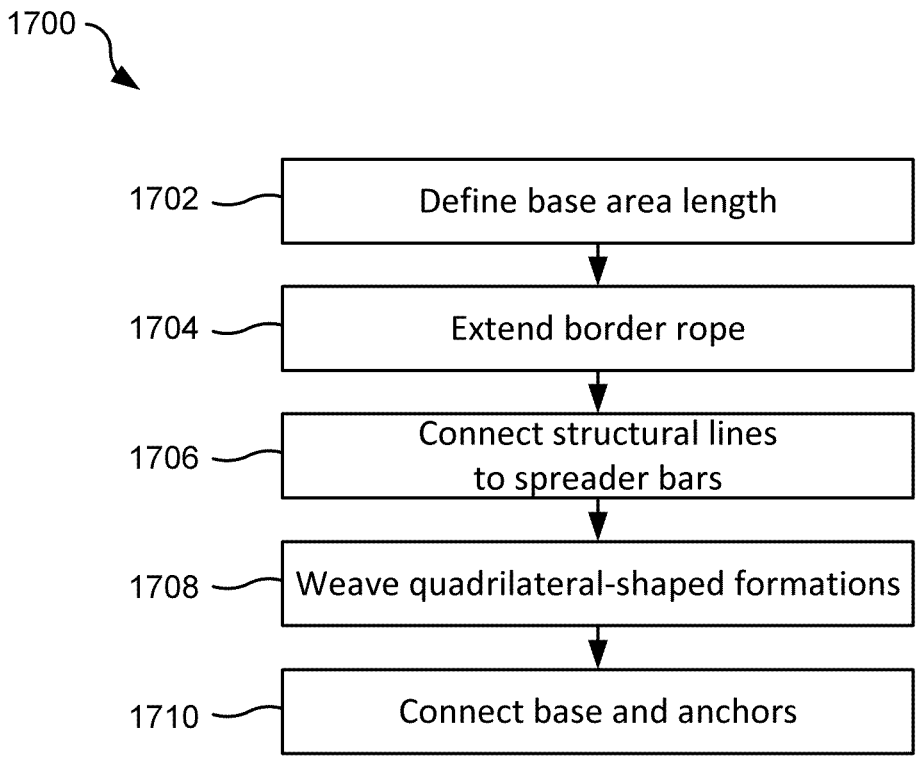
FIG. 17 illustrates example operations for manufacturing a hammock system.

FIG. 17 illustrates example operations 1700 for manufacturing a hammock system. During the operations, two spreader bars define a length of a base area of the hammock system in a defining operation 1702. Two border rope extend to define a width of a base area of the hammock system in an extension operation 1704. A plurality of longitudinally extending structural lines connect to both a first spreader bar to a second spreader bar in a connecting operation 1706. A weaving rope is then weaved around the border rope and structural lines to define a repeating array of quadrilateral-shaped formations in a defining operation 1708. Each quadrilateral-shaped is bisected by one structural line. A connector rope connects the base and two sets of anchors in a connecting operation 1710. The connector rope is positioned on both the interior sides and exterior sides of the spreader bars, feeding through the drilled holes of the spreader bars, and knotting on both sides of the spreader bars to both the base and anchors.

It is to be understood that even though numerous characteristics and advantages of various implementations of the present invention have been set forth in the foregoing description, together with the details of the structure and function of various implementations of the invention, this disclosure is by way of example only, not by limitation. The weaving concepts herein are not limited to use or application with any specific system or method that employs the components as specifically arranged in the illustrative implementations of the disclosure. That is, although the instrumentalities described herein are for the convenience of explanation, shown and described with respect to exemplary implementations, it will be appreciated that the principles herein may be applied equally in other types of systems and methods. The implementations described above and other implementations are within the scope of the following claims.

What is claimed is:

1. A hammock system, which comprises:
- two spreader bars defining a length of a base area of the hammock system;
- two border ropes defining a width of the base area of the hammock system;
- a plurality of longitudinally extending structural lines of equal length connecting the first spreader bar to the second spreader bar parallel to the two parallel border ropes; and
- a weaving rope of smaller width than the structural lines defining a repeating array of quadrilateral formations within the base area, each quadrilateral formation bisected by one of the structural lines.

2. The hammock system of claim 1, wherein the quadrilateral formations are diamonds.

3. The hammock system of claim 1, wherein the structural lines are positioned substantially equidistant and in substantial parallel alignment to each other.

4. The hammock system of claim 1, wherein the structural lines, the border ropes, and the weaving rope connect together to create an overall rectangular web formation.

5. The hammock system of claim 1, further comprising two sets of anchors, wherein a first end of each individual anchor in each set of anchors feeds through a series of holes in the two spreader bars and secures in a knot on an interior side of each of the spreader bars.

6. The hammock system of claim 5, wherein the anchors secure in a knot on the interior side of the spreader bars to one or both of the structural lines and the border ropes.

7. The hammock system of claim 5, wherein the individual anchors secure on the interior side of each of the spreader bars to the structural lines by looping through an end of the structural lines before knotting to the anchors themselves.

8. The hammock system of claim 1, wherein a connector rope connects the base and two sets of anchors, the connector rope positioned on both interior sides and exterior sides of the spreader bars, feeding through the drilled holes of the spreader bars, and knotting on both sides of the spreader bars to both the base and anchors.

9. The hammock system of claim 1, further comprising a plurality of hooks, each of the hooks connecting to the second end of each set of anchors and configured to secure the hammock system to a structure.

10. The hammock system of claim 2, wherein the array of quadrilateral formations includes further a row of at least six diamond-shaped formations running longitudinally across the length of each structural line.

11. A hammock system, which comprises:
- two spreader bars defining a length of a base area of the hammock system;
- two border ropes defining a width of the base area of the hammock system;
- a plurality of longitudinally extending structural lines of equal length connecting the first spreader bar to the second spreader bar, wherein structural lines are positioned substantially equidistant and in substantial parallel alignment to each other and the two parallel border ropes;
- a weaving rope of smaller width than the structural lines defining a repeating array of quadrilateral-shaped formations within the base area, each quadrilateral formation bisected by one of the structural lines;

a connector rope connecting the base and two sets of anchors, the connector rope positioned on both interior sides and exterior sides of the spreader bars, feeding through the holes in the spreader bars, and knotting on both sides of the spreader bars to both the base and anchors; and a plurality of hooks, each of the hooks connecting to the second end of each set of anchors and configured to secure the hammock system to a structure.

12. A method of manufacturing a hammock system, which comprises:

defining a length of a base area of the hammock system between two substantially parallel spreader bars;

extending two border ropes connecting the spreader bars to define a width of a base area of the hammock system;

connecting a plurality of longitudinally extending structural lines of equal length from a first spreader bar to a second spreader bar; and weaving a weaving rope of smaller width than the structural lines around the border ropes and structural lines to define a repeating array of quadrilateral formations, each quadrilateral formations bisected by one structural line.

13. The method of claim 12, wherein weaving the rope defines an array of repeating diamond-shaped formations running longitudinally across the length of each of the structural lines.

14. The method of claim 13, wherein weaving the rope to create a row of at least six diamond-shaped formations running longitudinally across the length of each of the structural lines.

15. The method of claim 12, wherein weaving of structural lines, border ropes, and weaving rope is accomplished mechanically.

16. The method of claim 12, further comprising feeding anchors through a series of holes in the two spreader bars and securing in a knot on interior side of each of the spreader bars.

17. The method of claim 16, further comprising securing anchors in a knot on the interior side of the spreader bars either to themselves, to the structural lines, or to the border ropes.

18. The method of claim 12, further comprising securing individual anchors on interior side of each of the spreader bars to structural lines by looping through an end of the structural lines before knotting to the anchors themselves.

19. The method of claim 12, wherein a connector rope connects the base area and two sets of anchors, the connector rope positioned on both interior sides and exterior sides of the spreader bars, feeding through the drilled holes of the spreader bars, and knotting on both sides of the spreader bars to both the base and anchors.

20. The method of claim 12, wherein weaving the rope further comprises wrapping a first rope around the structural lines and wrapping a second rope around the first rope and the structural lines, wherein the wrapping secures the first rope and the second rope to the structural lines and defines the repeating array of quadrilateral formations.

* * * * *